US012474087B2

(12) United States Patent
Zhong et al.

(10) Patent No.: US 12,474,087 B2
(45) Date of Patent: Nov. 18, 2025

(54) HOUSING AND DUCT-TYPE AIR CONDITIONER

(71) Applicants: GD MIDEA AIR-CONDITIONING EQUIPMENT CO., LTD., Foshan (CN); MIDEA GROUP WUHAN HEATING & VENTILATING EQUIPMENT CO., LTD., Wuhan (CN)

(72) Inventors: Ruiqiong Zhong, Foshan (CN); Lin Zhang, Foshan (CN)

(73) Assignees: GD MIDEA AIR-CONDITIONING EQUIPMENT CO., LTD., Foshan (CN); MIDEA GROUP WUHAN HEATING & VENTILATING EQUIPMENT CO., LTD., Wuhan (CN)

( * ) Notice: Subject to any disclaimer, the term of this patent is extended or adjusted under 35 U.S.C. 154(b) by 290 days.

(21) Appl. No.: 18/030,035

(22) PCT Filed: Dec. 24, 2021

(86) PCT No.: PCT/CN2021/141174

§ 371 (c)(1),
(2) Date: Apr. 3, 2023

(87) PCT Pub. No.: WO2022/143455

PCT Pub. Date: Jul. 7, 2022

(65) Prior Publication Data

US 2023/0375221 A1 Nov. 23, 2023

(30) Foreign Application Priority Data

Dec. 30, 2020 (CN) ..... 202023338814.6
Mar. 15, 2021 (CN) ..... 202120533083.6

(51) Int. Cl.
*F24F 13/28* (2006.01)
*F24F 8/108* (2021.01)
*F24F 13/20* (2006.01)

(52) U.S. Cl.
CPC ..... *F24F 13/28* (2013.01); *F24F 8/108* (2021.01); *F24F 13/20* (2013.01)

(58) Field of Classification Search
CPC ..... F24F 8/108
See application file for complete search history.

(56) References Cited

U.S. PATENT DOCUMENTS 10,434,448 B1 * 10/2019 Honnecke ..... F24F 13/28

FOREIGN PATENT DOCUMENTS

CN 202792466 U 3/2013
CN 105352043 A * 2/2016 ..... F24F 13/24
(Continued)

OTHER PUBLICATIONS

CN105352043 and translation (Year: 2016).*
(Continued)

*Primary Examiner* — Steven S Anderson, II
(74) *Attorney, Agent, or Firm* — Anova Law Group, PLLC

(57) ABSTRACT

A housing includes a shell and a clamp plate. An air return opening is provided on one side of the shell. The clamp plate includes a fixation plate and a clamp plate folded edge. Two ends of the fixation plate along a length direction of the fixation plate are connected to two side walls of the air return opening, respectively. The clamp plate and the two side walls of the air return opening form a slot for mounting a filter screen. The clamp plate folded edge is provided on a side surface of the fixation plate and arranged along the length direction of the fixation plate.

17 Claims, 12 Drawing Sheets

(56) References Cited

FOREIGN PATENT DOCUMENTS

| | | | |
|---|---|---|---|
| CN | 207649056 | U | 7/2018 |
| CN | 207763081 | U | 8/2018 |
| CN | 212005968 | U | 11/2020 |
| CN | 212157407 | U | 12/2020 |
| CN | 212157600 | U | 12/2020 |
| CN | 213983788 | U | 8/2021 |
| JP | 2002195640 | A | 7/2002 |
| KR | 101964307 | B1 | 4/2019 |

OTHER PUBLICATIONS

World Intellectual Property Organization (WIPO) International Search Report and Written Opinion for PCT/CN2021/141174 Mar. 23, 2022 16 Pages (with translation).

* cited by examiner

HOUSING AND DUCT-TYPE AIR CONDITIONER

CROSS-REFERENCE TO RELATED APPLICATIONS

The present application is a National Stage Entry under 35 U.S.C. § 371 of International Application No. PCT/CN2021/141174, filed on Dec. 24, 2021, which claims priority to Chinese Application No. 202023338814.6, filed on Dec. 30, 2020 and entitled "DUCT-TYPE AIR CONDITIONER," and Chinese Application No. 202120533083.6, filed on Mar. 15, 2021 and entitled "HOUSING AND AIR CONDITIONER," the entire contents of each of which are incorporated herein by reference.

TECHNICAL FIELD

The present application relates to the technical field of air conditioner, and in particular, to a housing and a duct-type air conditioner.

BACKGROUND

In the related arts, a duct-type air conditioner is one of air conditioners. The duct-type air conditioner is generally provided with a shell. The shell is provided with an air return opening, where a filter screen is further provided for filtering air entering the shell. A filter screen cover plate of the duct-type air conditioner is fixed on the shell of the duct-type air conditioner by screws. When the filter screen of the shell needs to be replaced or cleaned, tools may be needed to disassemble and assemble the screws that fix the filter screen cover plate, and the process of replacing the filter screen is complicated. In addition, in order to ensure that the filter screen can be mounted stably at the air return opening of the shell, a clamp plate may be provided at the air return opening of the shell. In the process of carrying the duct-type air conditioner, an operator may lift up the duct-type air conditioner with the clamp plate by applying a force on it. However, the clamp plate of the duct-type air conditioner at present is a flat metal sheet, which has a poor structural strength, result in an easy deformation during the process of carrying. The clamp plate would block the filter screen, thereby the replacement of the filter screen is impeded.

SUMMARY

The present application aims at solving at least one of the technical problems in the related art. To this end, the present application provides a housing and a duct-type air conditioner with an improved strength of a clamp plate, such that the clamp plate is not easy to deform, and the replacement of a filter screen is easier.

The housing according to the exemplary embodiments of the present application includes a shell and a clamp plate. An air return opening is provided on one side of the shell. The clamp plate includes a fixation plate, and a first clamp plate folded edge provided on a side surface of the fixation plate. The first clamp plate folded edge is arranged along a length direction of the fixation plate. Two ends of the fixation plate along the length direction are respectively connected to two side walls of the air return opening, so that the clamp plate and the two side walls of the air return opening form a slot, which is provided for installation of a filter screen.

According to some exemplary embodiments of the present application, the clamp plate further includes a second clamp plate folded edge, and the first clamp plate folded edge and the second clamp plate folded edge are located oppositely on the same side surface of the fixation plate.

According to some exemplary embodiments of the present application, a width of the first clamp plate folded edge is less than a width of the second clamp plate folded edge.

According to some exemplary embodiments of the present application, an edge of the second clamp plate folded edge is provided with an edge plate. The edge plate is arranged along the length direction of the fixation plate, and a free end of the edge plate is located between the first clamp plate folded edge and the second clamp plate folded edge.

According to some exemplary embodiments of the present application, the edge plate is inclined towards a side at which the fixation plate is located.

According to some exemplary embodiments of the present application, an angle between the edge plate and the second clamp plate folded edge ranges from 0° to 90°.

According to some exemplary embodiments of the present application, the angle between the edge plate and the second clamp plate folded edge ranges from 30° to 80°.

According to some exemplary embodiments of the present application, each of two ends of the fixation plate is provided with a mounting member. The mounting members are connected and fixed to the two side walls of the air return opening, respectively. Correspondingly, each of two ends of the second clamp plate folded edge is provided with an avoidance notch at a position where the mounting member is provided.

According to some exemplary embodiments of the present application, the clamp plate is provided with a reinforcement rib. And the reinforcement rib is arranged along the length direction of the fixation plate.

According to some exemplary embodiments of the present application, the reinforcement rib is stamped and formed in a middle portion of the fixation plate. The reinforcement rib and the first clamp plate folded edge are located on a same side surface of the fixation plate.

The exemplary embodiments of the present application further provide a duct-type air conditioner, which includes the housing as described above.

According to the housing and the duct-type air conditioner of the exemplary embodiments of the present application, a slot on the clamp plate is formed between the air return opening of the shell and the shell for mounting the filter screen, such that the filter screen is stably installed at the air return opening of the shell. The fixation plate of the clamp plate is provided with the first clamp plate folded edge, thereby increasing the strength of the clamp plate. During carrying, since the first clamp plate is arranged along the length direction of the fixation plate, the fixation plate is not easy to bend and deform, and is more reliable and durable.

The exemplary embodiments of the present application further provide a housing, including a shell and a cover plate assembly. An opening is provided on one side of the shell. An air return channel and a filter screen mounting position are provided within the shell. One end of the air return channel is provided with an air return opening, and the filter screen mounting position is provided at the air return opening. The cover plate assembly includes a sealing plate, a batten and a filter screen cover plate. The sealing plate is covered on the opening, and the sealing plate shields a portion of area of the opening in a way that at least portions of area of the opening are opened to form a filter screen disassembling and assembling opening, which is communicated with the filter screen mounting position. The batten is pressed on the sealing plate. The filter screen cover plate is capable of being opened and closed at the filter screen disassembling and assembling opening to selectively open or close the filter screen disassembling and assembling opening. When the filter screen cover plate is in a closed state of blocking the filter screen disassembling and assembling opening, the filter screen cover plate is in a clamp connection with the batten.

According to some exemplary embodiments of the present application, one side of the sealing plate adjacent to the filter screen disassembling and assembling opening is provided with a landing edge formed by bending. The landing edge abuts against the shell, the batten is pressed on the landing edge. The batten, the landing edge and the shell are firmly connected through a fastener.

According to some exemplary embodiments of the present application, the filter screen cover plate is rotatably connected to the shell. Alternately, the filter screen cover plate and the shell are in a split structure, and when the filter screen cover plate is in the closed state, the filter screen cover plate abuts against or is clamped with the shell.

According to some exemplary embodiments of the present application, an accommodation groove is provided on a side of the filter screen cover plate. When the filter screen cover plate is in the closed state, the batten is located in the accommodation groove, and the filter screen cover plate is clamped with the batten by elastic deformation of the filter screen cover plate.

According to some exemplary embodiments of the present application, a first elastic buckle is formed on a side wall of the filter screen cover plate, and a second elastic buckle is formed on a side wall of the batten. When the filter screen cover plate is in the closed state, the first elastic buckle is clamped with the second elastic buckle.

According to some exemplary embodiments of the present application, an accommodation groove is provided on a side of the filter screen cover plate. When the filter screen cover plate is in the closed state, the batten is located in the accommodation groove.

According to some exemplary embodiments of the present application, the filter screen cover plate is provided with a first folded edge, a second folded edge, a third folded edge and a fourth folded edge, which are folded towards a same side of the filter screen cover plate. The first folded edge and the second folded edge are oppositely arranged, and the third folded edge and the fourth folded edge are oppositely arranged. The accommodation groove is enclosed and formed by the first folded edge, the second folded edge, the third folded edge and the fourth folded edge. The first elastic buckle is provided on the first folded edge.

According to some exemplary embodiments of the present application, the shell is provided with a first abutment edge, which is located at one side of the filter screen disassembling and assembling opening. A portion of the second folded edge is turned and folded outward to form a second abutment edge. When the filter screen cover plate is in the closed state, the second abutment edge extends into the filter screen disassembling and assembling opening and abuts against the first abutment edge.

Alternately, the cover plate assembly further includes two rotation arms, one end of each rotation arm is connected to the filter screen cover plate, the other end of each rotation arm extends into the filter screen disassembling and assembling opening and is rotatably connected to an inner wall of the shell. When the filter screen cover plate is in the closed state, the filter screen cover plate and the shell shield the two rotation arms.

According to some exemplary embodiments of the present application, the filter screen cover plate is provided with a hold member.

The exemplary embodiments of the present application further provide a duct-type air conditioner, including the housing as mentioned above.

According to the housing and the air conditioner of the exemplary embodiments of the present application, the housing includes the shell and the cover plate assembly. The sealing plate is covered on the opening. The sealing plate shields a portion of area of the opening in a way that at least portions of area of the opening are opened to form the filter screen disassembling and assembling opening communicated with the filter screen mounting position. The batten is pressed on the sealing plate. When the filter screen cover plate is in the closed state of sealing the filter screen disassembling and assembling opening, the filter screen cover plate and the batten provided on the sealing plate can be fixed by clamping, thereby the filter screen cover plate does not need to be fixed by screws. Therefore, when disassembling the filter screen, an operator can open or close the filter screen cover plate without using a tool. Thus, the disassembling and assembling process of the filter screen is simplified and the replacement of the filter screen is facilitated.

Some of the additional aspects and advantages of the present application will be given in the following description, and others will become apparent from the following description, or will be learned through the practice of the present application.

Figure 1:
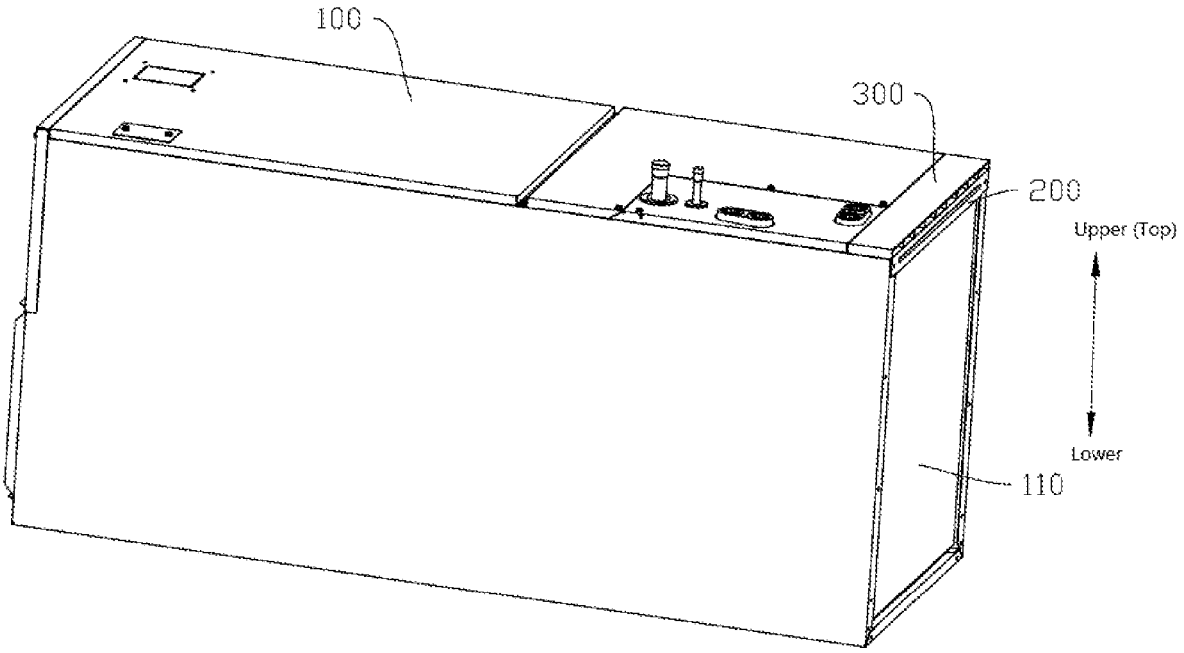
FIG. 1 is a schematic diagram of a filter screen mounted at a shell of a duct-type air conditioner according to an embodiment of the present application.

Reference numerals in FIG. 1-FIG. 5:

100 refers to shell 100, 110 refers to air return opening, and 120 refers to side wall;

200 refers to clamp plate, 210 refers to fixation plate, 211 refers to mounting member, 220 refers to first clamp plate folded edge, 230 refers to second clamp plate folded edge, 240 refers to edge plate, 250 refers to reinforcement rib, and 260 refers to avoidance notch; and

300 refers to filter screen.

Reference numerals in FIG. 6-FIG. 12:

10 refers to shell, 10*a* refers to air return channel, 10*b* refers to filter screen mounting position, 10*c* refers to filter screen disassembling and assembling opening, and 10*d* refers to first abutment edge; and

20 refers to cover plate assembly, 21 refers to sealing plate, 21*a* refers to landing edge, 211 refers to first sub-plate, 212 refers to second sub-plate, 22 refers to batten, 22*a* refers to second elastic buckle, 23 refers to filter screen cover plate, 23*a* refers to accommodation groove, 23*b* refers to first elastic buckle, 23*c* refers to first folded edge, 23*d* refers to second folded edge, 23*e* refers to third folded edge, 23*f* refers to fourth folded edge, 23*g* refers to second abutment edge, 23*h* refers to hold member, and 24 refers to rotation arm.

DETAILED DESCRIPTION

The exemplary embodiments of the present application will be described in detail hereinafter, examples of which are illustrated in the accompanying drawings, where the same or similar reference numerals indicate the same or similar elements or elements having the same or similar functions throughout. The embodiments described below with reference to the accompanying drawings are exemplary and are only intended to explain the present application, but should not be construed as limiting the present application.

In the description of the present application, it should be noted that the orientation or positional relationship indicated by the terms upper, lower, front, back, left, right and the like is based on the orientation or positional relationship shown in the drawings, only for the convenience of describing the application and simplifying the description, and does not indicate or imply that the indicated device or element must have a specific orientation, or be constructed and operated in a specific orientation. Therefore, the terms should not be construed as limiting the present application.

In the description of the present application, if there is a description term, e.g., first or second, it is only for the purpose of distinguishing technical features, and shall not be understood as indicating or implying relative importance, the number of the indicated technical features, and precedence relationship of the indicated technical features.

In the description of the present application, unless otherwise explicitly defined, words such as setting, installing and connecting should be understood in a broad sense, and those skilled in the art can reasonably determine the specific meanings of the above words in the present application in combination with the specific contents of the technical solutions.

At present, a duct-type air conditioner is usually provided with a cuboid-shaped shell 100, and various components for making cold air or hot air, such as a chassis component, an electric control module, a wind turbine fan module, a water receiving tray and an evaporator, are placed inside the shell 100. The shell 100 may be enclosed by an upper cover plate, a lower cover plate, a lower enclosure plate and a piping pressing plate. Two ends of the shell 100 in a length direction are provided with an air return opening 110 and an air outlet, respectively. A filter screen 300 is generally provided at the air return opening 110 for filtering air entering the shell 100. During the operation of the duct-type air conditioner, the air is sucked from the air return opening and discharged from the air outlet after being cooled or heated. In order to make the filter screen 300 be stably mounted at the air return opening 110, a clamp plate 200 for the filter screen 300 is usually provided at the air return opening 110. At present, the clamp plate 200 is generally made rectangular, and two ends of the clamp plate in a length direction are connected and fixed to left and right side walls 120 of the air return opening 110, respectively. The clamp plate 200 has the function of clamping and fixing the filter screen 300 to the air return opening 110 of the shell 100. Moreover, it is also necessary to apply a lifting force to the clamp plate 200 when carrying the duct-type air conditioner. However, the current clamp plate 200 has a poor strength and is easy to bend and deform during the process of carrying.

Figure 2:
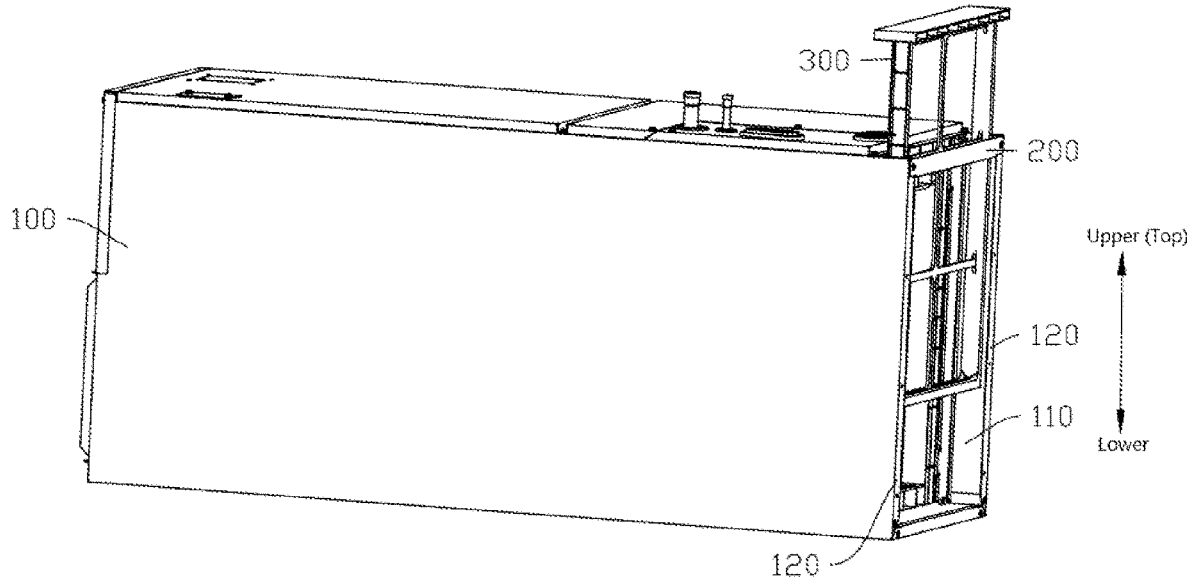
FIG. 2 is a schematic diagram of a filter screen extracted from a shell of a duct-type air conditioner according to an embodiment of the present application.
Figure 3:
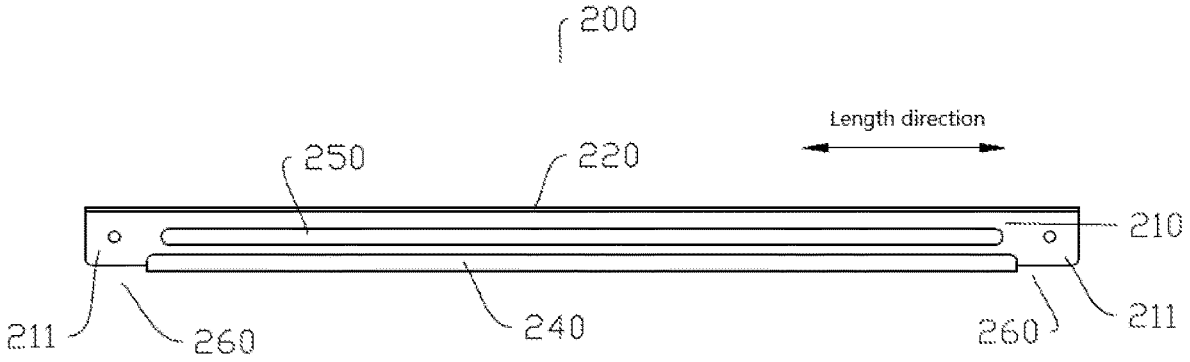
FIG. 3 is a schematic diagram of a clamp plate from a first view according to an embodiment of the present application.

Referring to FIG. 1, FIG. 2 and FIG. 3, the exemplary embodiments of the present application provide a duct-type air conditioner. The duct-type air conditioner includes a shell 100 and a clamp plate 200. The clamp plate 200 includes a fixation plate 210 and a first clamp plate folded edge 220. Two ends of the fixation plate 210 along the length direction are connected and fixed to left and right side walls 120 of the air return opening 110 respectively, such that a slot is formed between the clamp plate 200 with each side wall 120 of the air return opening 110. The slot is provided for mounting a filter screen 300. When installing, the filter screen 300 is inserted into the slot from top to bottom, thereby the filter screen 300 is fixed at the air return opening 110 of the shell 100. As the first clamp plate folded edge 220 is provided on the fixation plate 210, the strength of the fixation plate 210 is improved. Moreover, since the first clamp plate folded edge 220 is arranged along the length direction of the fixation plate 210, the fixation plate 210 is hard to bend and deform. Each end corner of the first clamp plate folded edge 220 may be set as a round corner, which can lower the risks of being cut by the sharp end corners.

Figure 4:
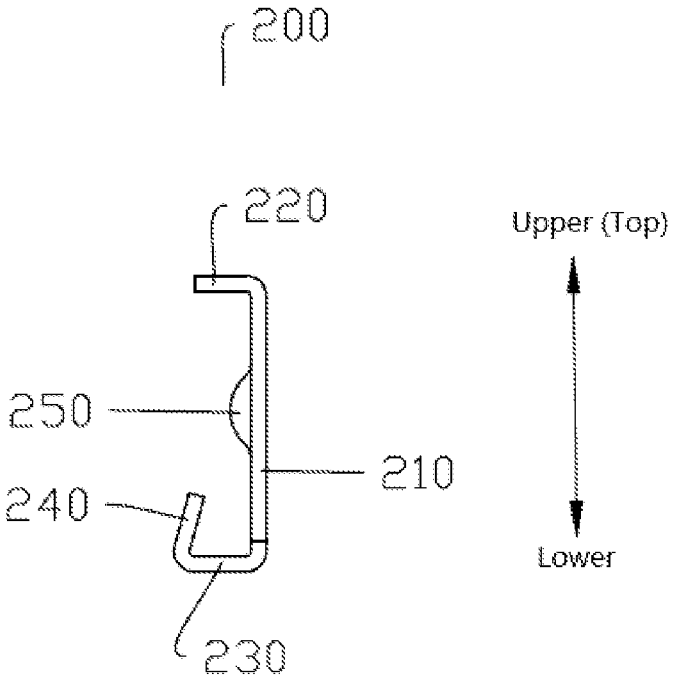
FIG. 4 is a schematic diagram of the clamp plate from a second view according to an embodiment of the present application.
Figure 5:
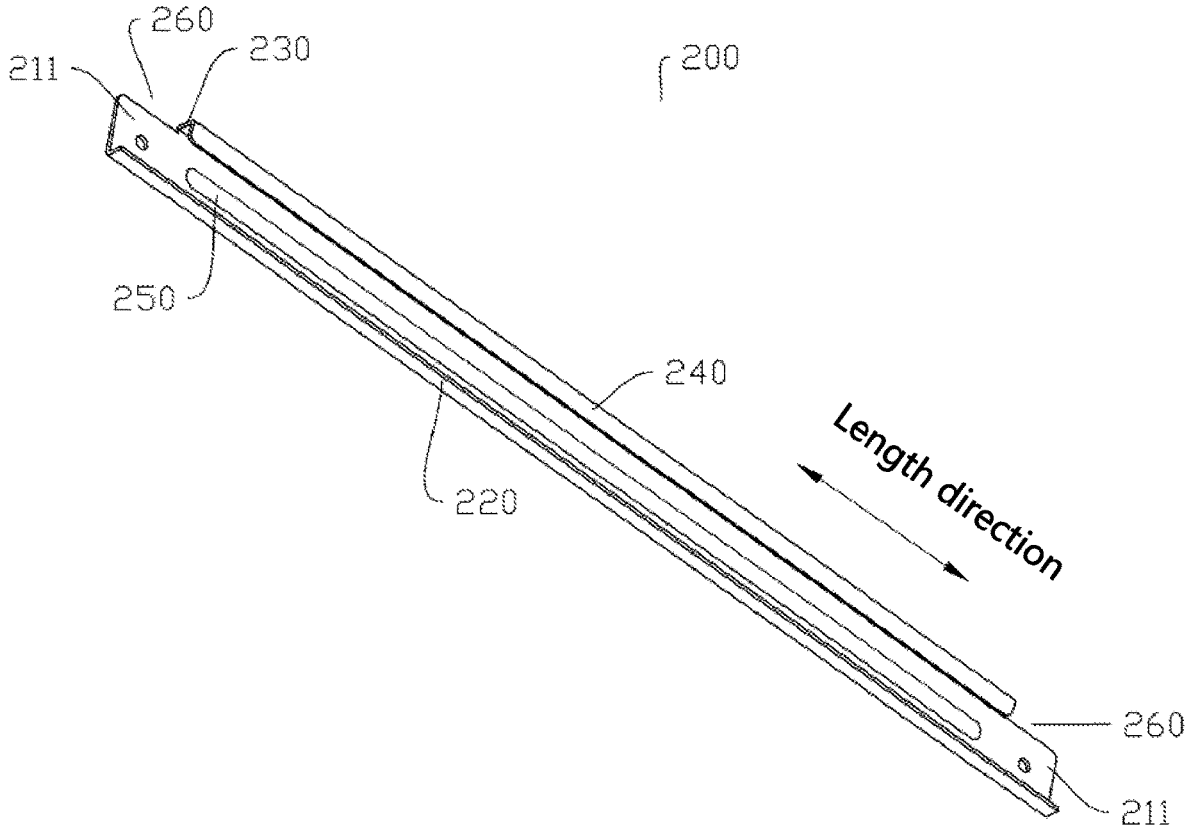
FIG. 5 is a schematic diagram of the clamp plate from a third view according to an embodiment of the present application.
Figure 6:
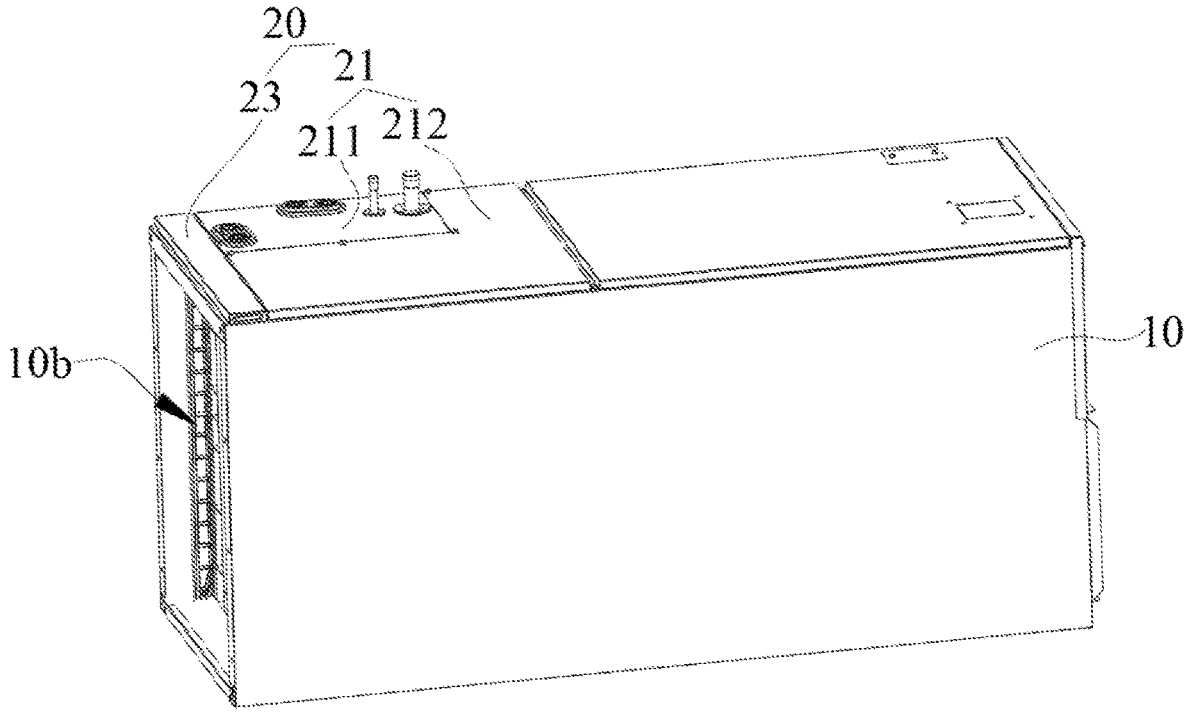
FIG. 6 is a structural schematic diagram of a housing according to an embodiment of the present application, where a filter screen cover plate in the figure is in a closed state.
Figure 7:
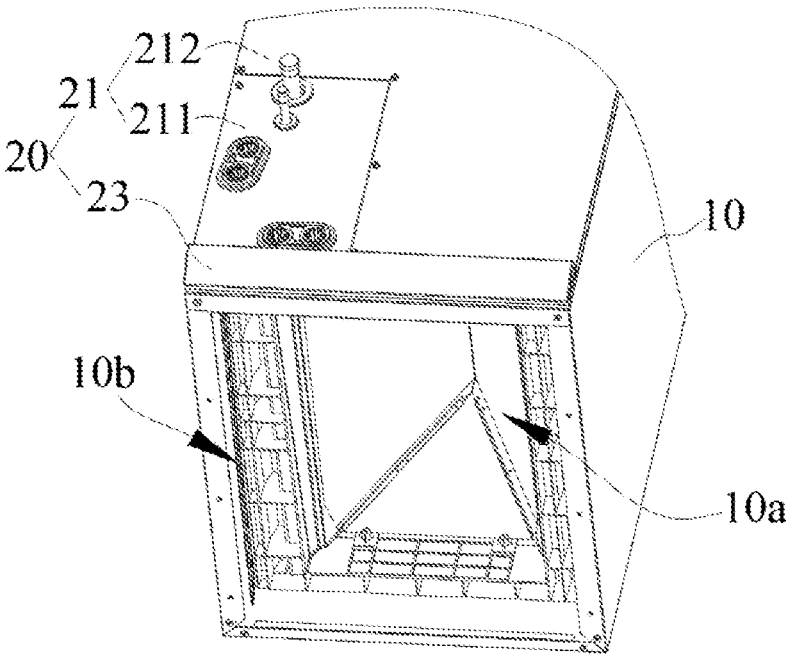
FIG. 7 is a partial structural schematic diagram of the housing shown in FIG. 6 from another view, where the filter screen cover plate in the figure is in an open state.

With reference to FIG. 3, FIG. 4 and FIG. 5, it may be understood that the clamp plate 200 further includes a second clamp plate folded edge 230. The fixation plate 210 may be a rectangular plate. The first clamp plate folded edge 220 and the second clamp plate folded edge 230 are located oppositely at upper and lower sides of the same side surface of the fixation plate 210. The first clamp plate folded edge 220 and the second clamp plate folded edge 230 may be obtained by bending the upper and lower sides of the fixation plate 210. The first clamp plate folded edge 220 may be arranged vertically to the fixation plate 210, and the first clamp plate folded edge 220 and the second clamp plate folded edge 230 may be arranged parallel to each other. The strength of the fixation plate 210 can be further increased by providing the two folded edges. During mounting, the side where the first clamp plate folded edge 220 and the second clamp plate folded edge 230 are located is extended to an inside of the shell 100, so as to facilitate holding by palm during carrying.

With reference to FIG. 4, it may be understood that a width of the first clamp plate folded edge 220 is less than a width of the second clamp plate folded edge 230. When the clamp plate 200 is mounted to the shell 100, the first clamp plate folded edge 220 abuts against an upper end face of the shell 100, and the second clamp plate folded edge 230 is embedded into the shell 100 from the air return opening 110. A projection of the first clamp plate folded edge 220 in a vertical direction is farther than a projection of the second clamp plate folded edge 230 from the filter screen 300. Because the filter screen 300 has a certain weight, once the filter screen 300 is pulled out or inserted into the slot, the filter screen is easy to tilt to the side where the clamp plate 200 is located. Therefore, the width of the first clamp plate folded edge 220 is set to be less than the width of the second clamp plate folded edge 230, so that the filter screen 300 may not be damaged due to being scraped by the first clamp plate folded edge 220 when the filter screen is inserted into or pulled out of the slot.

With reference to FIG. 3, FIG. 4 and FIG. 5, it may be understood that an edge of the second clamp plate folded edge 230 is provided with an edge plate 240. The edge plate 240 is arranged along the length direction of the fixation plate 210, and the edge plate 240 is extended to the first clamp plate folded edge 220. The second clamp plate folded edge 230 and the edge plate 240 may be in a shape of rectangular. The edge plate 240 may be formed by bending the second clamp plate folded edge 230. The strength of the clamp plate 200 can be further increased by arranging the edge plate 240 on the clamp plate folded edge 230. Each end corner of a free end of the edge plate 240 may also be set as a rounded corner, which can lower the risks of being cut by the sharp end corners.

With reference to FIG. 3, FIG. 4 and FIG. 5, it may be understood that the edge plate 240 is obliquely arranged, and the edge plate 240 faces away from the slot. The side plate 240 is arranged obliquely and away from the slot, that is, the free end of the side plate 240 is inclined toward the side where the fixation plate 210 is located. With such arrangement, in the process of carrying, as a certain angle is provided between the edge plate 240 and the second clamp plate folded edge 230, fingers of an operator are difficult to touch and be scratched by edge of the edge plate 240, and palms and the fingers may bend along the second clamp plate folded edge 230 and the edge plate 240, thereby achieving a better holding feeling. When the filter screen 300 is pulled out of the slot or inserted into the slot, the free end of the edge plate 240 may not scratch the filter screen 300 in the above process because the edge plate 240 is obliquely arranged and facing away from the slot, so that the filter screen 300 may not be damaged by being scratched from the free end of the edge plate 240.

With reference to FIG. 3, FIG. 4 and FIG. 5, it may be understood that an angle between the edge plate 240 and the second clamp plate folded edge 230 may range from 0° to 90°, so that an acute angle or a right angle is formed between the edge plate 240 and the second clamp plate folded edge 230. Compared with an obtuse angle, it leads to a good holding feeling since the edge plate 240 and the second clamp plate folded edge 230 has a better position for force application.

With reference to FIG. 3, FIG. 4 and FIG. 5, it may be understood that the angle between the edge plate 240 and the second clamp plate folded edge 230 may be set to range from 30° to 80°. When the angle between the edge plate 240 and the second clamp plate folded edge 230 is set to range from 30° to 80°, for example, 75°, the fingers of the operator are less likely to touch the edge of the edge plate 240, and the holding feeling may be more comfortable.

With reference to FIG. 3, FIG. 4 and FIG. 5, it may be understood that two ends of the fixation plate 210 are each provided with a mounting member 211. The mounting members 211 are connected and fixed to the two side walls 120 of the air return opening 110. Each of two ends of the second clamp plate folded edge 230 and the edge plate 240 is provided with an avoidance notch 260. The side wall 120 of the shell 100 may have a certain thickness. When the clamp plate 200 is mounted to the air return opening 110 of the shell 100, it is necessary to embed the second clamp plate folded edge 230 and the folded plate into the shell 100 along the air return opening 110 for the sake of beauty. Therefore, each of the two ends of the second clamp plate folded edge 230 and the edge plate 240 in the length direction corresponding to the mounting members 211 of the fixation plate 210 is provided with an avoidance notch 260, so that the second clamp plate folded edge 230 and the edge plate 240 can be smoothly embedded inside the shell 100. The mounting members 211 provided at two ends of the fixation plate 210 may be connected and fixed to the two side walls 120 of the air return opening 110 by screws. A screw hole is formed in a middle portion of the mounting member 211, and a screw hole of the shell 100 corresponding to the screw hole of the mounting member 211 is formed in the side wall 120, and a screw can pass through the two screw holes above to fix the fixation plate 210 on the side wall 120 of the shell 100. The mounting member 211 of the fixation plate 210 may also be provided with a buckle, and a clamping groove is provided at a corresponding position of the side wall 120 of the shell 100. The mounting member 211 of the fixation plate 210 can fix the fixation plate 210 on the side wall 120 of the shell 100 through the matching of the buckle and the clamping groove.

With reference to FIG. 3, FIG. 4 and FIG. 5, it may be understood that the clamp plate 200 is provided with a reinforcement rib 250. The reinforcement rib 250 is arranged along the length direction of the fixation plate 210. The reinforcement rib 250 may be a cylindrical protrusion towards an inner cavity of the shell 100. The reinforcement rib 250 may be disposed in parallel to the first clamp plate folded edge 220 and the second clamp plate folded edge 230. The strength of the clamp plate 200 can be further increased with the reinforcement rib 250 arranged along the length direction of the fixation plate 210.

With reference to FIG. 3, FIG. 4 and FIG. 5, it may be understood that the reinforcement rib 250 may be formed by directly punching the middle portion of the fixation plate 210, and the reinforcement rib 250 and the first clamp plate folded edge 220 are located on a same side surface of the fixation plate 210. The reinforcement rib 250 is formed by punching the middle portion of the fixation plate 210, so that the integrity of the fixation plate 210 is improved. Compared with other methods, corresponding materials can be saved. Moreover, the reinforcement rib 250 is arranged on the same side surface of the fixation plate 210 as the first clamp plate folded edge 220, so that the protruding parts of the fixation plate 210 such as the first clamp plate folded edge 220, the second clamp plate folded edge 230 and the reinforcement rib 250 are each extended to the side where the cavity of the shell 100 is located, thereby a part of the fixation plate 210 facing outside is relatively flat, the duct-type air conditioner can offer a better holding feeling when carrying. The overall aesthetics of the duct-type air conditioner can also be improved.

It may be understood that the shell 100 is connected to the filter screen 300, and a top of the filter screen 300 is provided with a magnetic component. The magnetic component may be a magnet, which may be a permanent magnet or an electromagnet connected by a circuit. When the filter screen 300 is inserted into the slot, the magnetic component at the top of the filter screen 300 is attracted to a top side wall of the shell 100. After the filter screen 300 is inserted into the slot of the shell 100 from top to bottom, a bottom of the filter screen 300 abuts against a bottom of the shell 100, the magnet on the filter screen 300 is opposite to an end face of the top side wall of the shell 100, and the magnet can be attracted and attached to the end face of the top side wall of the shell 100. The way of attaching the filter screen 300 to the shell 100 by the magnetic component can reduce the use of screws and other connectors, thereby the assembling and disassembling of the filter screen 300 in the slot is facilitated, and the assembling and disassembling efficiency of the filter screen 300 is improved.

With reference to FIG. 1 to FIG. 5, in some exemplary embodiments, the duct-type air conditioner is assembled and formed by mounting internal components in a lower enclosure of the shell 100, and subsequently mounting the upper cover plate, the lower cover plate and the piping pressing plate. The mounting members 211 at the two ends of the fixation plate 210 of the clamp plate 200 are connected and fixed to the side walls 120 at two sides of the air return opening 110 of the shell 100 by screws, so that the clamp plate 200 is mounted at the air return opening of the shell 100. The upper side of the fixation plate 210 of the clamp plate 200 is bent to obtain the first clamp plate folded edge 220 and the lower side is bent to obtain the second clamp plate folded edge 230. When mounting the clamp plate 200 to the shell 100, the fixation plate 210 is fixedly connected to the shell 100, and a lower end face of the first clamp plate folded edge 220 abuts against an upper end face of the shell 100, so that the clamp plate 200 can be mounted on the shell 100 more stably. The upper end face of the shell 100 may be a flange provided at the top of the left or right side wall 120 of the shell 100. The second clamp plate folded edge 230 of the clamp plate 200 is embedded into the cavity of the shell 100 through the air return opening 110 of the shell 100. An edge of the second clamp plate folded edge 230 is also provided with an edge plate 240, and the edge plate 240 may be formed by bending the second clamp plate folded edge 230. The edge plate 240 is obliquely arranged towards the side where the fixation plate 210 is located, so that the operator can have a better holding feeling during transportation. In the process of carrying the duct-type air conditioner, the operator usually holds the second clamp plate folded edge 230 and the edge plate 240 with the palms, and then lifts the duct-type air conditioner upward. The edge plate 240 and the second clamp plate folded edge 230 are inclined by 75°, so that the operator has a better holding feeling and is difficult to be scratched by touching the edge of the edge plate 240. Moreover, the width of the first clamp plate folded edge 220 is less than the width of the second clamp plate folded edge 230, so that when the filter screen 300 is inserted into the slot, a situation that the filter screen 300 is scratched by the first clamp plate folded edge 200 or the edge plate 240 can be reduced.

One reinforcement rib 250 is formed in the middle portion of the fixation plate 210 by stamping. The first clamp plate folded edge 220, the second clamp plate folded edge 230, the edge plate 240 and the reinforcement rib 250 are simultaneously arranged on the same side surface of the fixation plate 210, thereby the strength of the clamp plate 200 can be effectively increased, and the clamp plate 200 is difficult to bend and deform during transportation. The protrusion of the reinforcement rib 250, the first clamp plate folded edge 220 and the second clamp plate folded edge 230 are arranged on the same side surface of the fixation plate 210, which is close to the side where the filter screen 300 of the shell 100 is installed, so that the second clamp plate folded edge 230 and the fixation plate 210 provide a position for the palm to exert force during carrying, without bringing discomfort to the palm due to the protruding of the reinforcement rib 250 and the first clamp plate folded edge 220 on the side surface of the fixation plate 210. The fixation plate 210 is formed in a rectangular shape, and the first clamp plate folded edge 220, the second clamp plate folded edge 230 and the edge plate 240 are also formed in a rectangular shape. The first clamp plate folded edge 220 and the second clamp plate folded edge 230 are respectively arranged at 90° with the fixation plate 210, and the first clamp plate folded edge 220, the second clamp plate folded edge 230 and the reinforcement rib 250 are arranged in parallel to each other. Rounded corners are arranged at each end corner of the fixation plate 210, the first clamp plate folded edge 220 and the edge plate 240, which can reduce a situation that the installer is cut by sharp end corners during mounting.

Each of the two left and right side walls 120 of the air return opening 110 of the shell 100 is provided with a folded edge in a vertical direction, so the side walls have a certain thickness. By arranging the avoidance notches 260 at the two ends of the clamp plate folded edge 230 and the edge plate 240, when the clamp plate 200 is mounted, the mounting members 211 at the two ends of the fixation plate 210 are fixedly connected to the folded edges of the two side walls 120, and the second clamp plate folded edge 230 and the edge plate 240 can be smoothly embedded into the cavity of the shell 100 through the air return opening 110, such that a side surface of the fixation plate 210 extending to outside is flat. A top of the filter screen 300 may be provided with a magnet. When the filter screen 300 is inserted into the slot formed by the enclosure of the clamp plate 200 and the shell 100, the magnet can be attracted and attached to a part of the shell 100 opposite to the top of the filter screen 300. It is convenient to disassemble the filter screen 300 by a magnetic component. The top of the filter screen 300 may be provided with a shell, and the magnet is embedded in the shell. After the filter screen 300 is mounted into the slot, the shell at the top of the filter screen 300 is matched with and abuts against the lower cover plate of the upper end face of the shell 100, which helps reducing the entry of external impurities into the shell 100.

With reference to FIG. 6 to FIG. 10, the exemplary embodiments of the present application also provide a housing. The housing includes a shell 10 and a cover plate assembly 20. An opening is provided on one side of the shell 10. An air return channel 10*a* and a filter screen mounting position 10*b* are provided in the shell 10. An air return opening is provided at one end of the air return channel 10*a*, and the filter screen mounting position 10*b* is provided at the air return opening. The cover plate assembly 20 includes a sealing plate 21, a batten 22 and a filter screen cover plate 23. The sealing plate 21 is covered on the opening, and the sealing plate 21 shields a portion of area of the opening in a way that at least portions of area of the opening are opened to form a filter screen disassembling and assembling opening 10*c*, which is communicated with the filter screen mounting position 10*b*. That is, after the sealing plate 21 shields the portion of area of the opening, an area of the opening not shielded by the sealing plate 21 is the open area of the opening. According to needs, a portion of the open area may be used as the filter screen disassembling and assembling opening 10*c*, or the whole open area may be used as the filter screen disassembling and assembling opening 10*c*. The batten 22 is pressed on the sealing plate 21. The filter screen cover plate 23 is capable of being opened and closed at the filter screen disassembling and assembling opening 10*c* to selectively open or close the filter screen disassembling and assembling opening 10*c*. When the filter screen cover plate 23 is in a closed state of sealing the filter screen disassembling and assembling opening 10*c*, the filter screen cover plate 23 is in a clamp connection with the batten 22.

The exemplary embodiments of the present application further provide a duct-type air conditioner. The duct-type air conditioner includes a filter screen and the housing according to any above embodiments of the present application. The filter screen is removably mounted on the filter screen mounting position 10*b*.

The batten 22 is used to press the sealing plate 21 to prevent an edge of the sealing plate 21 from being tilted. The filter screen is used to filter impurities such as dust and cotton wool in the air, so as to prevent the impurities such as dust and cotton wool from entering the duct-type air conditioner via the air return opening. The filter screen mounting position 10*b* is used to fix the filter screen, and the filter screen disassembling and assembling opening 10*c* communicated with the filter screen mounting position 10*b* is used to take and place the filter screen, that is, the filter screen dismounted from the filter screen mounting position 10*b* needs to be taken out from the filter screen disassembling and assembling opening 10*c*. Similarly, when mounting the filter screen, the filter screen needs to pass through the filter screen disassembling and assembling opening 10*c* before being placed on the filter screen mounting position 10*b*. The filter screen cover plate 23 is used to seal the filter screen disassembling and assembling opening 10*c*. Generally, it is only necessary to open the filter screen cover plate 23 when the filter screen needs to be disassembled and assembled.

In the related art, a filter screen cover plate of a duct-type air conditioner is fixed on a shell of the duct-type air conditioner by screws. When a filter screen needs to be removed, an operator needs to remove the screws fixing the filter screen cover plate with a tool to open the filter screen cover plate. Similarly, after the filter screen is mounted in the filter screen mounting position, the operator needs to use a tool to reinstall the previously removed screws to fix the filter screen cover plate on the shell, which is cumbersome and inconvenient to operate in a narrow space.

However, when the filter screen cover plate 23 according to the embodiments of the present application is in the closed state of sealing the filter screen disassembling and assembling opening 10*c*, the filter screen cover plate 23 and the batten 22 arranged on the sealing plate 21 are fixed by clamping, and the filter screen cover plate 23 does not need to be fixed by screws. Therefore, when disassembling and assembling the filter screen, the operator can open or close the filter screen cover plate 23 without using a tool, thereby the disassembling and assembling process of the filter screen is simplified and further the replacement of the filter screen is facilitated.

The opening of the shell 10 may be provided at a bottom, top or side of the shell 10.

The filter screen mounting position 10*b* may be set in a slot structure. When mounting the filter screen, the filter screen may be fixed by directly inserting into the slot. The filter screen mounting position 10*b* may also set be in other structural forms as long as the filter screen can be fixed.

The sealing plate 21 may be detachably connected to the shell 10. In an exemplary embodiment, the sealing plate 21 may be firmly connected to the shell 10 by a fastener such as a screw. However, the sealing plate 21 may also be non-detachably connected to the shell 10. In an exemplary embodiment, the sealing plate 21 may be fixedly connected to the shell 10 by ways of welding and bonding.

The sealing plate 21 may be an integral structure or a combined structure of multiple sub-plates. In an embodiment, referring to FIG. 6 and FIG. 7, the sealing plate 21 includes a first sub-plate 211 and a second sub-plate 212. The batten 22 is pressed on the first sub-plate 211 and the second sub-plate 212, that is, the batten 22 presses the first sub-plate 211 and the second sub-plate 212 at the same time. The first sub-plate 211 and the second sub-plate 212 may be firmly connected by a fastener such as a screw, or fixedly connected by ways of welding and bonding, and may also be unconnected.

In an embodiment, the first sub-plate 211 may be a piping pressing plate, that is, a through hole for piping to pass through may be provided on the piping pressing plate. The second sub-plate 212 may be a lower cover plate.

Figure 11:
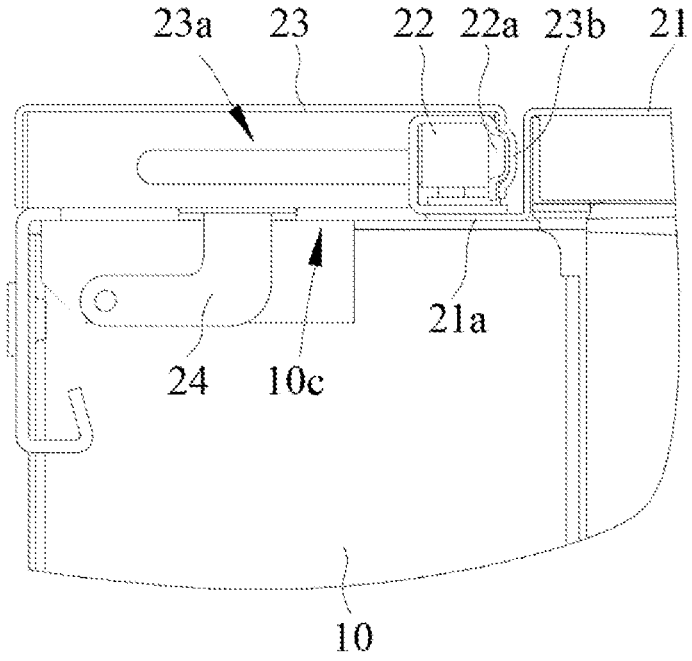
FIG. 11 is a schematic diagram of a matching relationship between a filter screen cover plate and a housing according to a second embodiment of the present application, where a filter screen cover plate in the figure is in a closed state.
Figure 12:
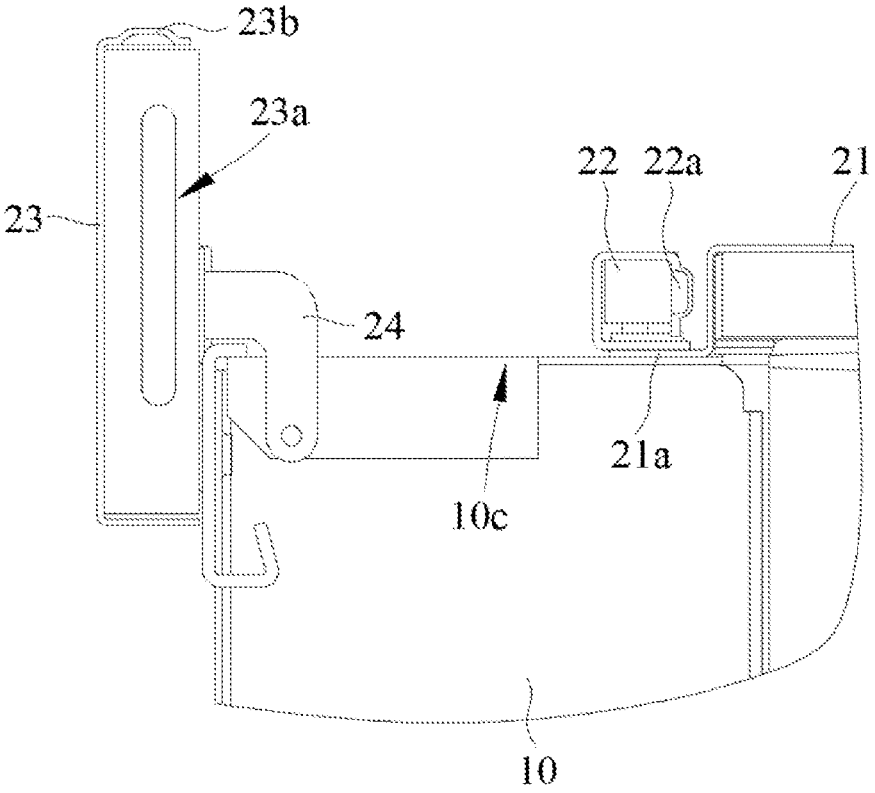
FIG. 12 is a structural schematic diagram showing the matching relationship between the filter screen cover plate and the housing when the filter screen cover plate in FIG. 11 is in an open state.

Referring to FIG. 11 and FIG. 12, the filter screen cover plate 23 may be rotatably connected to the shell 10. When the filter screen needs to be replaced, the operator only needs to rotate the filter screen cover plate 23 to open or close, without taking the filter screen cover plate 23 off the shell 10, so that the filter screen can be replaced more conveniently.

The filter screen cover plate 23 and the shell 10 may also be separated. It means that the filter screen cover plate 23 after being opened can be separated from the shell 10. When the filter screen cover plate 23 is in a closed state, the filter screen cover plate 23 is abutted against or is clamped with the shell 10, that is, when the filter screen cover plate 23 is in the closed state, the filter screen cover plate 23 may also be abutted against (as shown in FIG. 9 and FIG. 10) or clamped with the shell 10 while being clamped with the batten 22.

Figure 8:
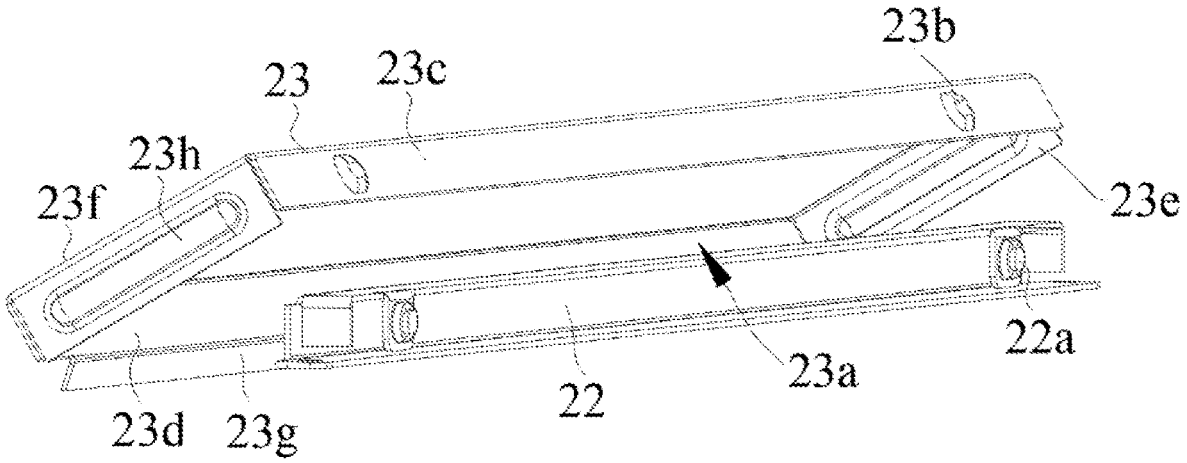
FIG. 8 is a schematic diagram showing a positional relationship between the filter screen cover plate and a batten shown in FIG. 6.
Figure 9:
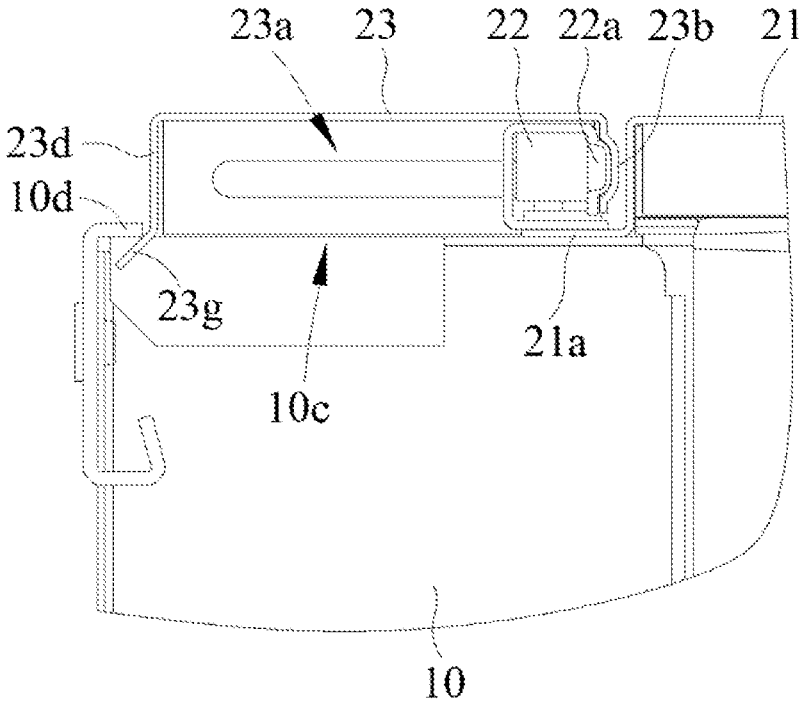
FIG. 9 is a structural schematic diagram of a matching relationship between the filter screen cover plate and the housing shown in FIG. 6, where the filter screen cover plate in the figure is in a closed state.
Figure 10:
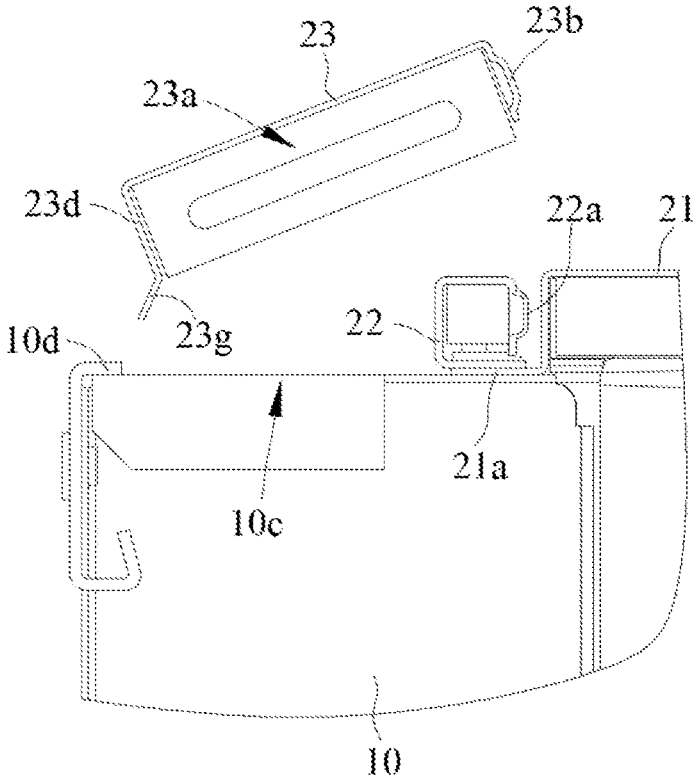
FIG. 10 is a structural schematic diagram showing the matching relationship between the filter screen cover plate and the housing when the filter screen cover plate in FIG. 9 is in an open state.

In an embodiment, referring to FIG. 8 to FIG. 10, a side of the sealing plate 21 adjacent to the filter screen disassembling and assembling opening 10*c* is provided with a landing edge 21*a* formed by bending. The landing edge 21*a* abuts against the shell 10, and the batten 22 is pressed on the landing edge 21*a*. The batten 22, the landing edge 21*a* and the shell 10 are firmly connected through a fastener.

The sealing plate 21 may be made of a thin metal plate, In an exemplary embodiment, the sealing plate 21 may be a sheet metal plate, and the batten 22 is pressed on the landing edge 21*a* to prevent the landing edge 21*a* from being tilted. The batten 22, the landing edge 21*a* and the shell 10 are firmly connected by the fastener, thereby the batten 22 can press the landing edge 21*a*, and the disassembling of the sealing plate 21 and the batten 22 is facilitated.

In an embodiment, referring to FIG. 8 to FIG. 10, a first elastic buckle 23*b* is formed on a side wall of the filter screen cover plate 23, and a second elastic buckle 22*a* is formed on a side wall of the batten 22. When the filter screen cover plate 23 is in the closed state, the first elastic buckle 23*b* is clamped with the second elastic buckle 22*a*.

When the filter screen cover plate 23 is in the closed state, the first elastic buckle 23*b* and the second elastic buckle 22*a* can be clamped together by elastic forces thereof. When the filter screen cover plate 23 needs to be opened, the operator only needs to apply a certain force to the filter screen cover plate 23, so that the first elastic buckle 23*b* can be separated from the second elastic buckle 22*a*, thereby facilitating the opening or closing of the filter screen cover plate 23.

A quantity of the first elastic buckle 23*b* may be one or more, and a quantity of the second elastic buckle 22*a* corresponds to the quantity of the first elastic buckle 23*b*. That is, each first elastic buckle 23*b* can be engaged with a corresponding second elastic buckle 22*a*.

In an embodiment, referring to FIG. 6 to FIG. 10, a side of the filter screen cover plate 23 is provided with an accommodation groove 23*a*. When the filter screen cover plate 23 is in the closed state, the batten 22 is located in the accommodation groove 23*a*. That is, when the filter screen cover plate 23 is in the closed state, the batten 22 may be hidden in the accommodation groove 23*a*, so that the housing is aesthetically favorable in appearance.

It may be understood that, in some embodiments, the batten 22 may also be arranged outside the filter screen cover plate 23.

Moreover, referring to FIG. 8 to FIG. 10, the first elastic buckle 23*b* and the second elastic buckle 22*a* are each configured to protrude outward. In some embodiments, the first elastic buckle 23*b* and the second elastic buckle 22a may also be each configured to be recessed inward. When the batten 22 is arranged outside the filter screen cover plate 23, one of the first elastic buckle 23*b* and the second elastic buckle may be arranged to protrude outward, and the other one of the first elastic buckle 23*b* and the second elastic buckle may be arranged to recess inward.

In an embodiment, referring to FIG. 6 to FIG. 10, the filter screen cover plate 23 is provided with a first folded edge 23*c*, a second folded edge 23*d*, a third folded edge 23*e* and a fourth folded edge 23*f*, all of which are folded towards a same side of the filter screen cover plate 23. The first folded edge 23*c* and the second folded edge 23*d* are oppositely arranged, the third folded edge 23*e* and the fourth folded edge 23*f* are oppositely arranged. The accommodation groove 23*a* is enclosed and formed by the first folded edge 23*c*, the second folded edge 23*d*, the third folded edge 23*e* and the fourth folded edge 23*f*. The first elastic buckle 23*b* is provided on the first folded edge 23*c*.

In an embodiment, referring to FIG. 8 to FIG. 10, the shell 10 is provided with a first abutment edge 10*d* located at one side of the filter screen disassembling and assembling opening 10*c*. A portion of area of the second folded edge 23*d* is turned outward to form a second abutment edge 23*g*. When the filter screen cover plate 23 is in the closed state, the second abutment edge 23*g* extends into the filter screen disassembling and assembling opening 10*c* and abuts against the first abutment edge 10*d*. That is, one side of the filter screen cover plate 23 may be clamped with the batten 22 through the first folded edge 23*c*, and the other side of the filter screen cover plate 23 may be abutted against the shell 10 through the second abutment edge 23*g*. Moreover, after the filter screen cover plate 23 is closed, the second abutment edge 23*g* may be hidden in the shell 10, so that the housing is aesthetically favorable in appearance.

In an embodiment, referring to FIG. 11 and FIG. 12, the cover plate assembly 20 further includes two rotation arms 24. One end of each rotation arm 24 extends into the accommodation groove 23*a* and is connected to the filter screen cover plate 23, the other end of each rotation arm 24 extends into the filter screen disassembling and assembling opening 10*c* and is rotatably connected to an inner wall of the shell 10. That is, the filter screen cover plate 23 may be rotatably connected to the inner wall of the shell 10 by the rotation arm 24. After the filter screen cover plate 23 is closed, the two rotation arms 24 may be hidden in the shell 10, so that the housing is aesthetically favorable in appearance.

It may be understood that the clamping between the filter screen cover plate 23 and the batten 22 is not limited to the first elastic buckle 23*b* and the second elastic buckle 22*a*. In an exemplary embodiment, when the filter screen cover plate 23 is in the closed state, the batten 22 is located in the accommodation groove 23*a*. When the filter screen cover plate 23 is in the closed state, the filter screen cover plate 23 can be clamped with the batten 22 by the elastic deformation of the filter screen cover plate, that is, an inner wall of the accommodation groove 23*a* and an outer wall of the batten 22 can be clamped by contact.

In an embodiment, referring to FIG. 8, the filter screen cover plate 23 is provided with a hold member 23*h*.

The hold member 23*h* is used for an operator to hold the filter screen cover plate 23 when opening or closing the filter screen cover plate 23. The hold member 23*h* may be configured in various ways. In an embodiment, referring to FIG. 8, the hold member 23*h* may be a buckle structure formed by a portion of area of the filter screen cover plate 23 protruding outward. In another embodiment, the hold member 23*h* may also be a handle and other structures configured on the filter screen cover plate 23.

In an embodiment, a duct-type air conditioner includes the housing as mentioned above. The housing includes a shell 10 and a shell 100. The shell 10 and the shell 100 each includes a clamp plate 200 and a cover plate assembly 20. Specific structures of the clamp plate 200 and the cover plate assembly 20 and effective effects thereof may be referred to the above description of the embodiments with reference to the drawings, and will not be repeated here.

The embodiments of the present application are described in detail with reference to the drawings above, but the present application is not limited to the above embodiments, and various changes may also be made within the knowledge scope of those of ordinary skills in the art without departing from the purpose of the present application.

What is claimed is:

1. A housing comprising:

a shell, an air return opening being provided on one side of the shell; and a clamp plate including:

a fixation plate, two ends of the fixation plate along a length direction of the fixation plate being connected to two side walls of the air return opening, respectively, and the clamp plate and the two side walls of the air return opening forming a slot for mounting a filter screen;

a first clamp plate folded edge provided on a side surface of the fixation plate and arranged along the length direction of the fixation plate; and a second clamp plate folded edge;

wherein:

the first clamp plate folded edge and the second clamp plate folded edge are located oppositely on a same side surface of the fixation plate;

an edge plate is provided at an edge of the second clamp plate folded edge and arranged along the length direction of the fixation plate, and a free end of the edge plate is located between the first clamp plate folded edge and the second clamp plate folded edge; and the edge plate is obliquely arranged towards a side at which the fixation plate is located.

2. The housing according to claim 1, wherein a width of the first clamp plate folded edge is less than a width of the second clamp plate folded edge.

3. The housing according to claim 1, wherein an angle between the edge plate and the second clamp plate folded edge is in a range from 0° to 90°.

4. The housing according to claim 3, wherein the angle between the edge plate and the second clamp plate folded edge is in a range from 30° to 80°.

5. The housing according to claim 1, wherein;

mounting members are provided at two ends of the fixation plate;

the mounting members are connected and fixed to the two side walls of the air return opening; and two ends of the second clamp plate folded edge are provided with avoidance notches at positions corresponding to the mounting members.

6. The housing according to claim 1, wherein the clamp plate is provided with a reinforcement rib, and the reinforcement rib is arranged along the length direction of the fixation plate.

7. The housing according to claim 6, wherein the reinforcement rib is stamped and formed in a middle portion of the fixation plate, and the reinforcement rib and the clamp plate folded edge are located on a same side surface of the fixation plate.

8. A duct-type air conditioner comprising the housing according to claim 1.

9. A housing comprising:

a shell, one side of the shell being provided with an opening, an air return channel being provided within the shell, an air return opening being provided at one end of the air return channel, and a filter screen mounting position being provided at the air return opening; and a cover plate assembly including:

a sealing plate provided at the opening, the sealing plate shielding a portion of area of the opening, at least a portion of an area of the opening forming a filter screen disassembling and assembling opening in communication with the filter screen mounting position;

a batten pressed on the sealing plate; and a filter screen cover plate provided at the filter screen disassembling and assembling opening and configured to open or close to selectively open or close the filter screen disassembling and assembling opening, the filter screen cover plate being configured to be in a clamp connection with the batten when the filter screen cover plate is in a closed state of sealing the filter screen disassembling and assembling opening;

wherein:

a side of the sealing plate adjacent to the filter screen disassembling and assembling opening is bent to form a landing edge abutting against the shell;

the batten is pressed on the landing edge; and the batten, the landing edge, and the shell are firmly connected through a fastener.

10. The housing according to claim 9, wherein:

the filter screen cover plate is rotatably connected to the shell; or the filter screen cover plate and the shell are in a split structure, and the filter screen cover plate and the shell are configured to abut against or clamp with each other when the filter screen cover plate is in the closed state.

11. The housing according to claim 9, wherein:

a side of the filter screen cover plate is provided with an accommodation groove; and when the filter screen cover plate is in the closed state, the batten is located in the accommodation groove, and the filter screen cover plate is clamped with the batten by elastic deformation of the filter screen cover plate.

12. The housing according to claim 9, wherein:

a first elastic buckle is formed on a side wall of the filter screen cover plate, and a second elastic buckle is formed on a side wall of the batten; and the first elastic buckle and the second elastic buckle are configured to clamp with each other when the filter screen cover plate is in the closed state.

13. The housing according to claim 12, wherein:

a side of the filter screen cover plate is provided with an accommodation groove; and the batten is configured to be located in the accommodation groove when the filter screen cover plate is in the closed state.

14. The housing according to claim 13, wherein:

the filter screen cover plate is provided with a first folded edge, a second folded edge, a third folded edge, and a fourth folded edge that are folded towards a same side of the filter screen cover plate;

the first folded edge and the second folded edge are oppositely arranged, and the third folded edge and the fourth folded edge are oppositely arranged;

the accommodation groove is enclosed and formed by the first folded edge, the second folded edge, the third folded edge, and the fourth folded edge; and the first elastic buckle is provided on the first folded edge.

15. The housing according to claim 14, wherein:

the shell is provided with a first abutment edge located at one side of the filter screen disassembling and assembling opening, a portion of the second folded edge folds outward to form a second abutment edge, and the second abutment edge is configured to extend into the filter screen disassembling and assembling opening and abut against the first abutment edge when the filter screen cover plate is in the closed state; or the cover plate assembly further includes two rotation arms each having one end connected to the filter screen cover plate and another end extending into the filter screen disassembling and assembling opening and rotatably connected to an inner wall of the shell, and the filter screen cover plate and the shell are configured to shield the two rotation arms when the filter screen cover plate is in the closed state.

16. The housing according to claim 9, wherein the filter screen cover plate is provided with a hold member.

17. A housing comprising:

a shell, an air return opening being provided on one side of the shell; and a clamp plate including:

a fixation plate, two ends of the fixation plate along a length direction of the fixation plate being connected to two side walls of the air return opening, respectively, and the clamp plate and the two side walls of the air return opening forming a slot for mounting a filter screen;

a first clamp plate folded edge provided on a side surface of the fixation plate and arranged along the length direction of the fixation plate; and a second clamp plate folded edge;

wherein:

the first clamp plate folded edge and the second clamp plate folded edge are located oppositely on a same side surface of the fixation plate;

mounting members are provided at two ends of the fixation plate;

the mounting members are connected and fixed to the two side walls of the air return opening; and two ends of the second clamp plate folded edge are provided with avoidance notches at positions corresponding to the mounting members.

* * * * *